United States Patent [19]

Kuroda

[11] 4,433,460

[45] Feb. 28, 1984

[54] APPARATUS FOR SPREADING AND GUIDING A WEB OF TEXTILE FABRIC

[76] Inventor: Mitsuru Kuroda, 16, Momoyama Mizuno Sakon Higashimachi, Fushimi-ku, Japan

[21] Appl. No.: 255,748

[22] Filed: Apr. 20, 1981

[30] Foreign Application Priority Data

Apr. 23, 1980 [JP] Japan ..... 55-54761

[51] Int. Cl.[3] ..... D06C 3/06

[52] U.S. Cl. ..... 26/75; 26/88; 226/15; 226/17

[58] Field of Search ..... 26/75, 77, 78, 88, 90, 26/98; 226/15, 17

[56] References Cited

U.S. PATENT DOCUMENTS

| | | | |
|---|---|---|---|
| 71,990 | 12/1867 | Corpe | 26/98 |
| 1,412,980 | 4/1922 | Tackaberry | 26/75 X |
| 2,581,821 | 1/1952 | Sutton | 26/98 |
| 3,094,760 | 6/1963 | Pickup | 26/98 X |
| 3,335,474 | 8/1967 | Cho | 26/78 |
| 3,822,448 | 7/1974 | Cho | 26/77 |

FOREIGN PATENT DOCUMENTS

| | | | |
|---|---|---|---|
| 55442 | 2/1891 | Fed. Rep. of Germany | 26/98 |
| 135758 | 12/1919 | United Kingdom | 26/75 |

*Primary Examiner*—Robert Mackey

*Attorney, Agent, or Firm*—Fidelman, Wolffe & Waldron

[57] ABSTRACT

Apparatus for spreading and guiding a web of textile fabric or the like being longitudinally fed, comprising a pair of web spreading and guiding devices disposed at opposite sides of the web, each device comprising a pair of rotary members rotatably supported in generally axially spaced apart and opposed relation to each other, with the axis of rotation of one of the rotary members being tilted relative to the axis of rotation of the other of the rotary members. The tilted rotary member is provided on the periphery thereof with a circular array of pushing members projecting toward the corresponding periphery of the other rotary member. As the two rotary members are rotated about their respective axes by friction with the running web held therebetween, the pushing members successively come to engage a selvage of the running web at a nipping point and disengage from the selvage at a releasing point. As the width or direction of the incoming web changes, the tilted rotary member is nutated about the axis of rotation of the other rotary member and simultaneously displaced along the axis so as to change the nipping point while keeping the releasing point substantially unchanged.

10 Claims, 16 Drawing Figures

68
69a
70a
70
69
71
17
33a
X
X'
37a
37b
46
46a
46b
46c
46e
46g
33
34
35
67

APPARATUS FOR SPREADING AND GUIDING A WEB OF TEXTILE FABRIC

This invention relates to an apparatus for spreading and guiding a longitudinally travelling web of textile fabric or the like.

There is known a web spreading and guiding machine which is provided with an opposed pair of rotary disks, between which the lateral edge portion of a web of cloth is held as the web is longitudinally fed.

The axis of rotation of one of the disks is inclined or tilted relative to that of the other disk and a circular array of needles or projections are provided on that surface of the periphery of the tilted disk which faces the surface of the other disk, so that as the disks are rotated, those of the needles or projections on an arcuate portion of the periphery of the tilted disk come to engage the lateral edge of the incoming web to pull it laterally outwardly. If the lateral edge of the web is displaced to either side, the tilted disk is nutated so that the arcuate portion of the disk, the needles or projections on which engage the lateral edge of the web, is angularly displaced in such a direction as to exert a pulling force on the lateral edge of the web so as to correct or compensate for the displacement thereof.

With this known machine, however, the "releasing" point at which the needles or projections release the lateral edge of the running web varies as the tilted disk nutates, with resulting instability in the running direction of the web or continuous meandering thereof.

Accordingly, the primary object of the invention is to provide a new and improved apparatus for spreading and guiding a longitudinally fed web of textile fabric or similar flexible material.

Another object of the invention is to provide such a web spreading and guiding apparatus as aforesaid which is capable of automatically guiding the web along a substantially constant path without displacement or meandering of the web.

Another object of the invention is to provide such a web-spreading and guiding apparatus as aforesaid which is capable of automatically spreading the web to a proper constant width.

The invention with its above and other objects, features and advantages will become apparent from the following description with reference to the accompanying drawings, wherein.

Figure 1:
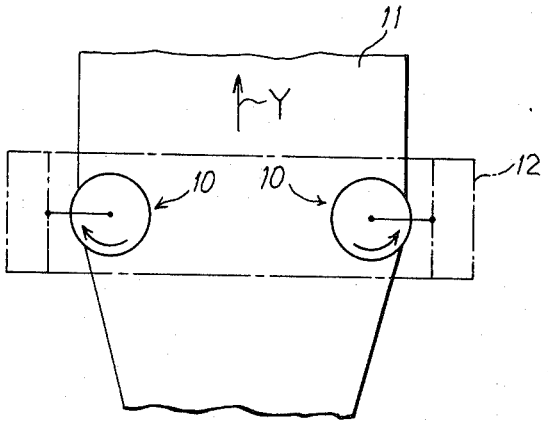
FIG. 1 is a schematic layout of the apparatus of the invention.

Now referring in detail to the drawings, first to FIG. 1, there are schematically shown a pair of web-stretching and guiding devices generally designated at 10 and disposed at opposite sides of a web 11 of cloth being fed by a multiple feeding machine (not shown) in a direction Y.

The two devices are mounted on a frame 12 schematically shown and disposed transversely of the running direction Y of the web in such a manner that the distance or space between the two devices can be changed in accordance with the width of the web 11. The two devices are of the same construction and will be commonly described in detail.

Figure 2:
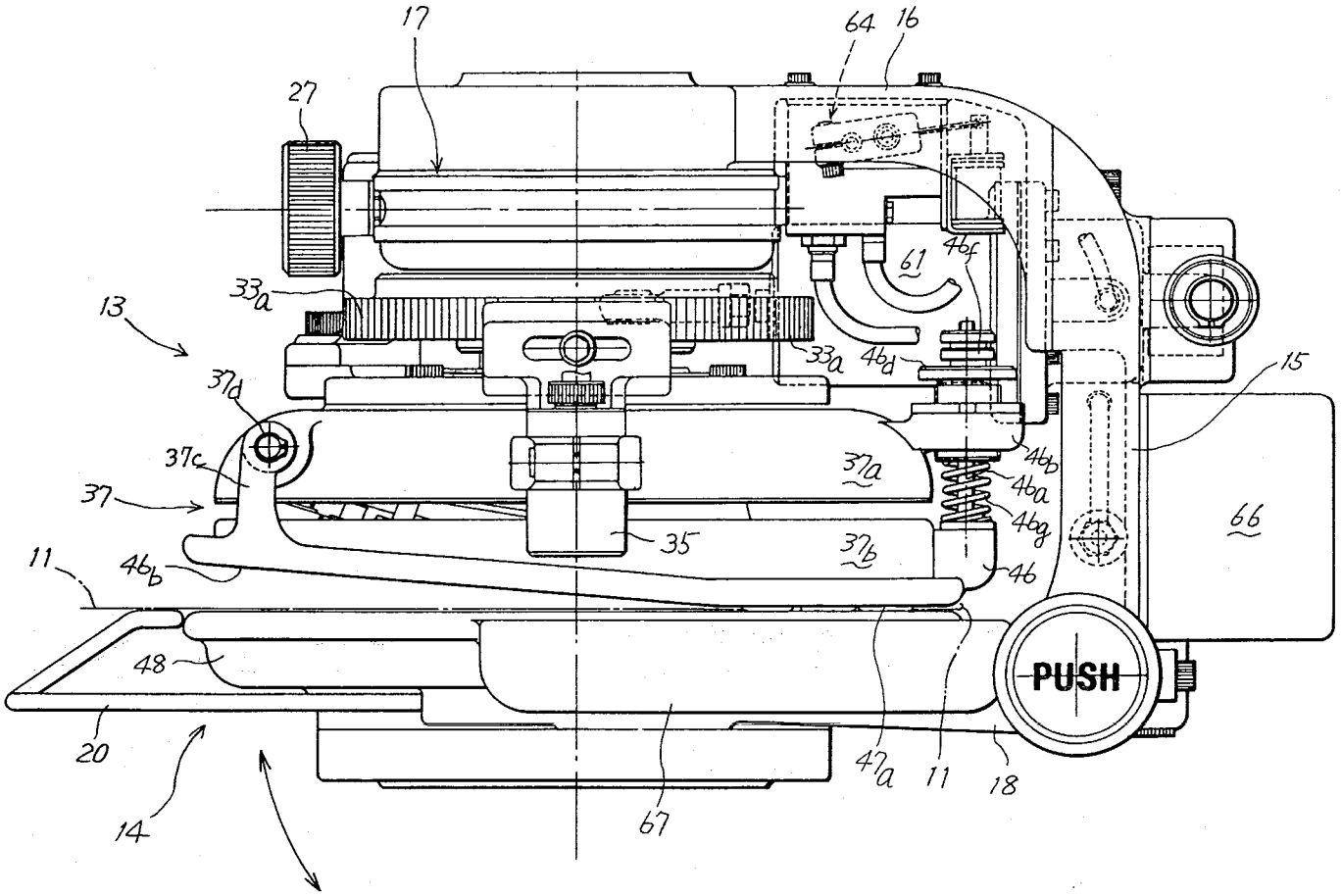
FIG. 2 is a front elevation of one of the web-spreading and guiding devices used in the apparatus of FIG. 1.
Figure 3:
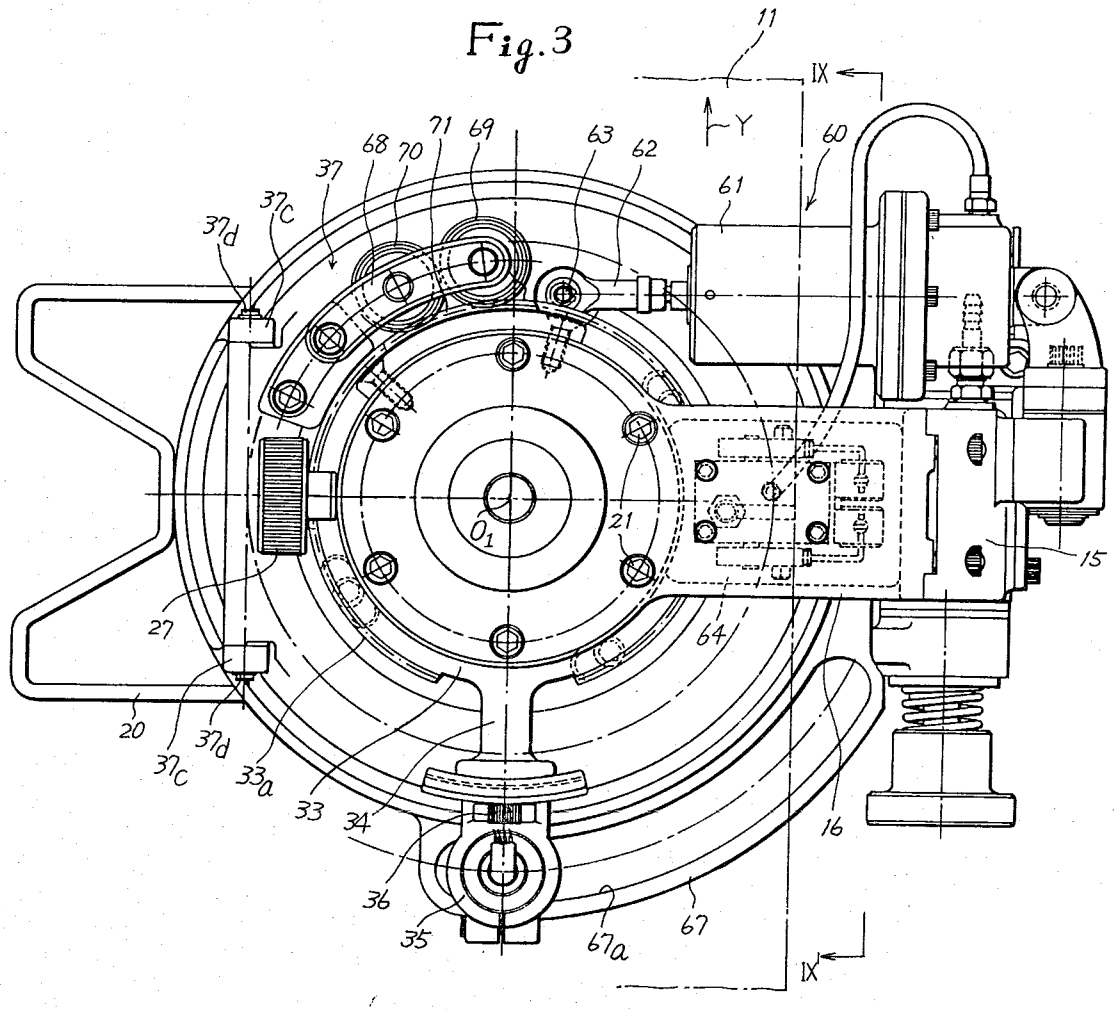
FIG. 3 is a top plan view of the device of FIG. 2.

Each device 10 comprises two sections 13 and 14 disposed in axially opposed relationship, with the lateral side portion of the web 11 to be stretched or expanded being passed between the opposed faces of the two sections as shown in FIG. 2. The sections 13 and 14 will be referred to as the upper and lower sections, respectively, only for the purpose of easier distinction between the two and not for definition of the actual relative position of the two sections while the device is in use.

The device 10 further comprises a bracket 15 having at one side thereof a curved arm 16, on the outer end of which the upper section 13 is mounted by means of a cylindrical casing 17. A movable arm 18 has its one end pivoted by a pin 19 to the opposite side of the bracket 15. The lower section 14 is formed integral with the outer end of the arm 18 so that the lower section 14 can be turned about the pin 19 as shown by the double headed arrow between a first position in which the lower section is disposed adjacent the upper section 13 and a second position in which the lower section is positioned away from the upper section for the lateral portion of the web 11 to be set between the two sections 13 and 14. A handle 20 is attached to the lower section 14 to make it easier to move the lower section.

Figure 4:
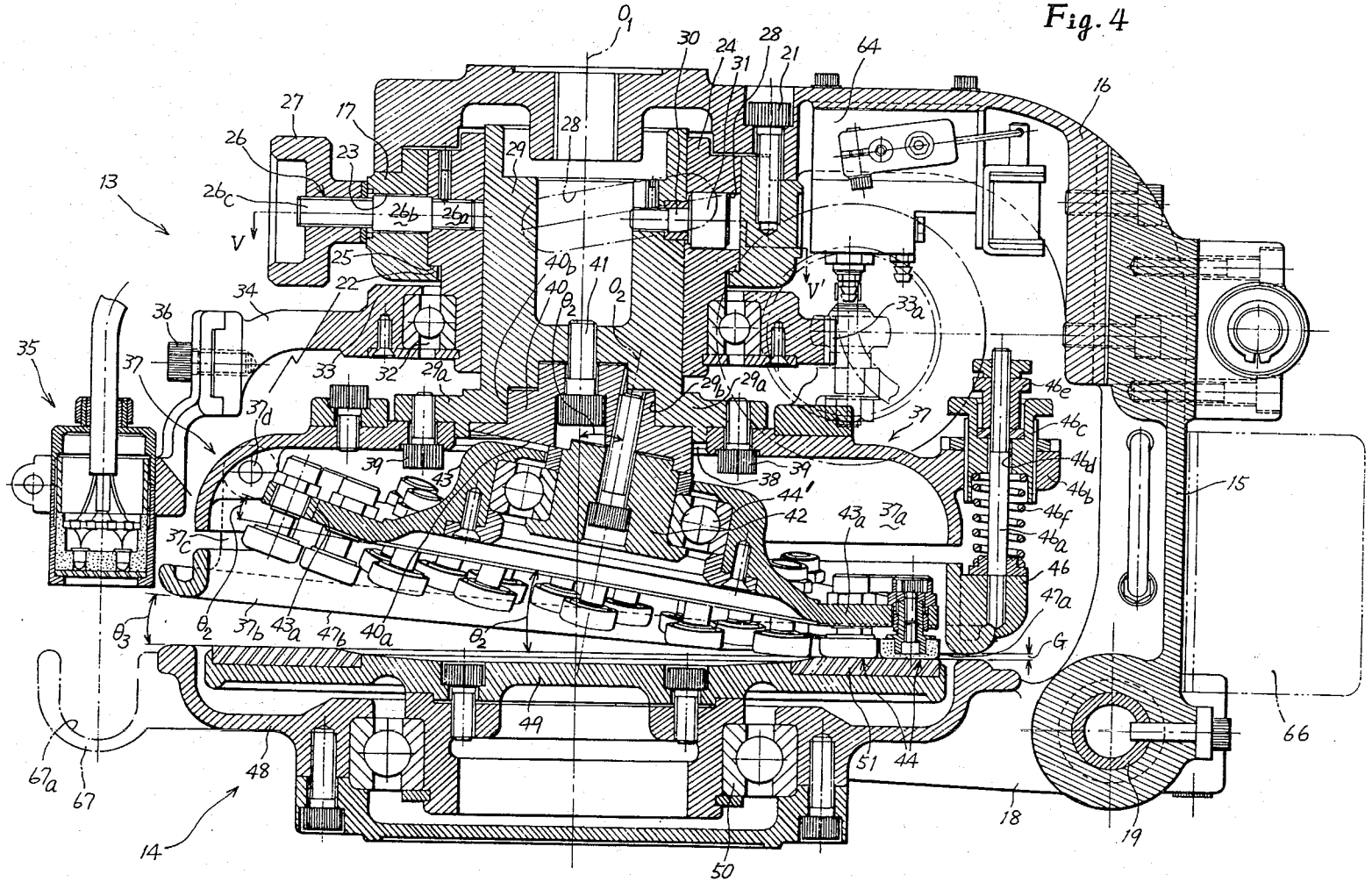
FIG. 4 is a vertical section in an enlarged scale of the device of FIGS. 2 and 3.
Figure 5:
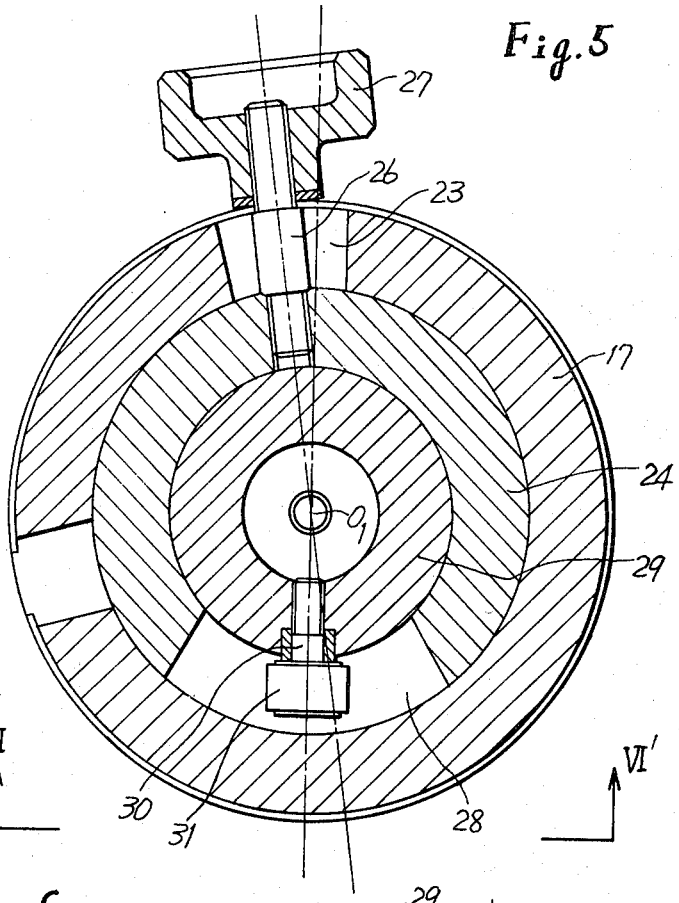
FIG. 5 is a transverse sectional view taken along the line V–V' of FIG. 4.
Figure 7:
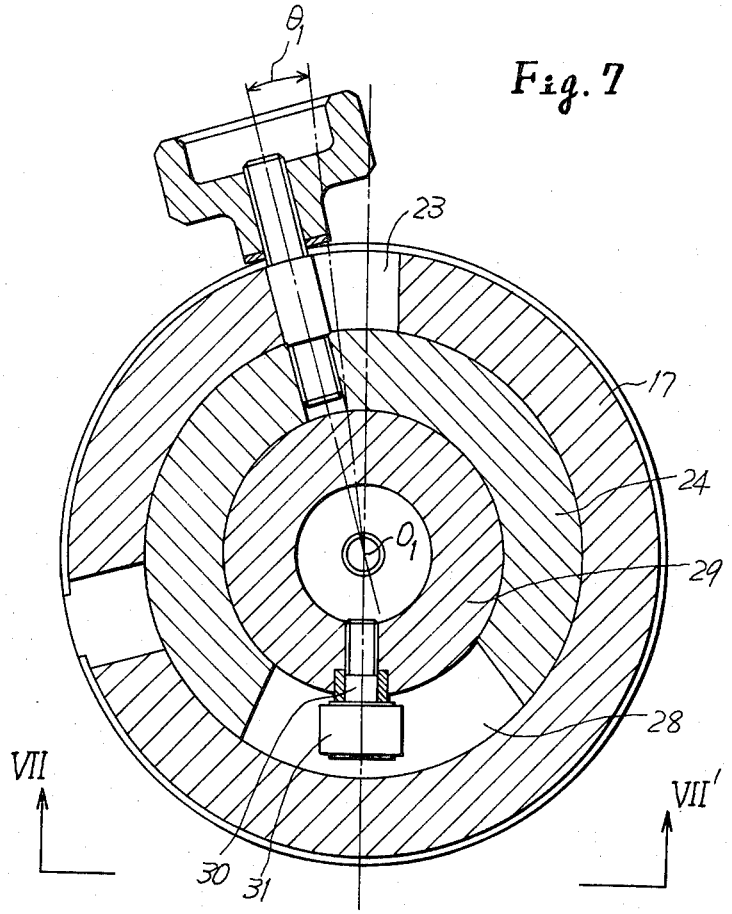
FIG. 7 is a transverse sectional view similar to FIG. 5 but in a different adjusted position.
Figure 8:
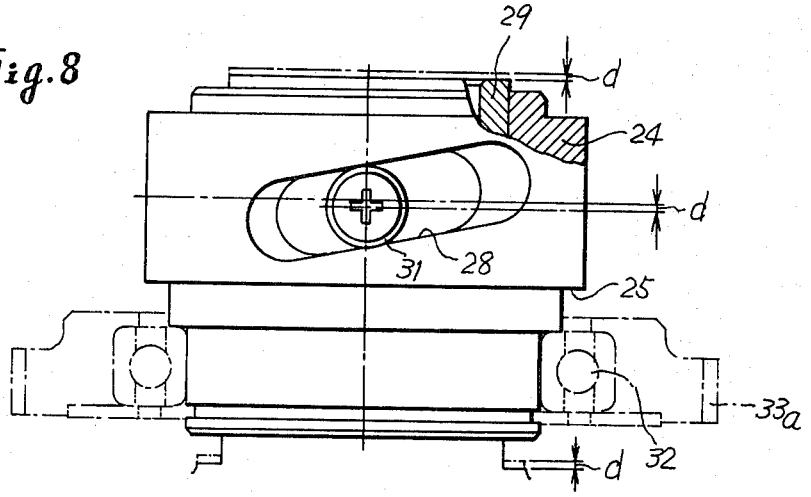
FIG. 8 is an elevational view as viewed from the plane of the line VII–VII' in FIG. 7, with the casing taken away.

The cylindrical casing 17 has its upper end secured by bolts 21 (only one of which is shown in FIG. 4) to the outer end of the curved arm 16 and its lower end formed with an inturned circumferential flange 22. The cylindrical casing 17 is formed with a guide slot 23 extending circumferentially a predetermined arcuate or angular distance as shown in FIGS. 4 and 5 or 7.

A hollow guide cylinder 24 is disposed within the cylindrical casing 17 rotatably about an axis $0_1$ relative to the casing. On the outer surface of the guide cylinder 24 about the middle of the axial length thereof there is formed a circumferential shoulder 25 which engages the inturned flange 22 of the cylindrical casing 17 so that the guide cylinder 24 is prevented from dropping out of the casing 17 and is rotatable therein.

A radially extending operating pin 26 has its inner end **26*a* threadedly secured to the hollow guide cylinder 24 and is provided on the middle portion of its axial length with a roller 26*b* engaging the guide slot 23, with a knob 27 threaded to the outer end portion 26*c* thereof so that the knob 27** can alternatively be fastened and unfastened. The angular position of the guide cylinder 24 about the axis $0_1$ can be changed from outside by handling the pin 26.

At the side diametrically opposite to the operating pin 26, the hollow guide cylinder 24 is formed with a guide slot 28 extending circumferentially a predetermined arcuate or angular distance as shown in FIGS. 4 and 5 to 8. The slot 28 is so formed as to be inclined a predetermined angle relative to the horizontal line downwardly to the left (or upwardly to the right) as viewed in FIGS. 6 or 8.

A support cylinder 29 is disposed inside the outer hollow guide cylinder 24 coaxially therewith and in such a manner that the inner support cylinder 29 is rotatable about the axis $0_1$ and at the same time axially slidable relative to the outer guide cylinder 24. To this end a radial pin 30 has its inner end secured threadedly to the inner support cylinder 29 and is provided at the outer end thereof with a roller 31 engaging the inclined slot 28.

Figure 6:
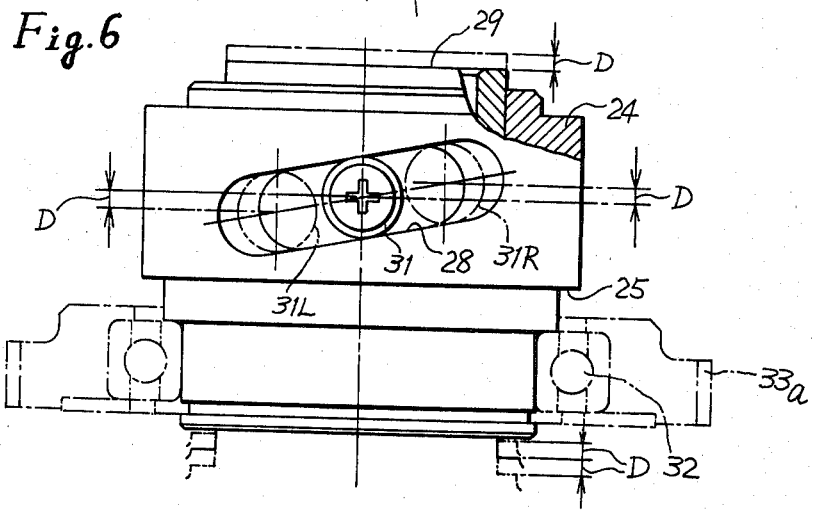
FIG. 6 is an elevational view as viewed from the plane of the line VI–VI' in FIG. 5, with the support casing taken away.

Under the condition as shown in FIGS. 5 and 6, if the knob 27 is unfastened on the pin 26, which is moved counterclockwise in FIG. 5, the guide cylinder 24 is turned or displaced in the same direction, that is, counterclockwise about the axis $0_1$. The counterclockwise displacement of the cylinder 24 causes the inclined slot 28 therein to be displaced from the position shown in FIG. 6 rightward to the position shown in FIG. 8. In other words, the roller 31 and consequently the pin 30 is relatively displaced in the inclined slot 28 toward the left with resulting axial displacement of the inner cylinder 29 downwardly relative to the outer cylinder 24 by an axial distance d.

Coming back to FIGS. 5 and 6, suppose that the outer cylinder 24 is fixed at the position shown relative to the casing 17, with the knob 27 fastened on the pin 26. Under the condition, if the inner cylinder 29 is turned about the axis $0_1$ clockwise and alternatively counterclockwise, the cylinder 29 is axially displaced within and relative to the fixed outer cylinder 24 downwardly and alternatively upwardly, with the roller 31 on the pin 30 sliding in the inclined slot 28 downwardly to the left and alternatively upwardly to the right as shown in FIG. 6. To put it in detail, if the inner cylinder 29 is turned clockwise in FIG. 5 from the middle position of the roller 31 in the inclined slot 28 until the roller 31 reaches the left-hand position shown at 31L, the inner cylinder 29 is simultaneously axially lowered a distance D.

On the contrary, if the inner cylinder 29 is turned counterclockwise in FIG. 5 from the middle position of the roller 31 until the roller 31 reaches the right-hand position 31R, the inner cylinder 29 is simultaneously axially raised the same distance D. In this manner, as the inner cylinder 29 is turned in either direction about the axis $0_1$ relative to the outer cylinder 24, the inner cylinder 29 is simultaneously axially lowered or raised.

It should be noted that the terms indicating the positions of a member or the directions of movement, such as "right", "left", "horizontal", "vertical", "upwardly", downwardly", "clockwise", "counterclockwise", etc. are used to indicate the positions or directions as viewed only in the drawings and not the actual positions or directions as viewed when the machine is mounted for practice use.

Suppose that the outer cylinder 24 is now fixed at the position shown in FIG. 7 which is displaced counterclockwise an angle $\theta_1$ from the position of the cylinder 24 in FIG. 5, with the inner cylinder 29 having been lowered the distance d from the position in FIG. 5. Under the condition, if the inner cylinder 29 is turned about its axis $0_1$ clockwise in FIG. 7, it is simultaneously axially lowered in a manner similar to that abovementioned with reference to FIGS. 5 and 6. On the contrary, if the inner cylinder 29 is turned counterclockwise in FIG. 7, it is simultaneously axially raised.

To that portion of the outer cylinder 24 which depends from the inturned flange 22 of the cylindrical casing 17 there is mounted through an annular bearing 32 a support ring 33 having an integral, generally radial arm 34, on the outer end of which a photoelectric sensor 35 is fixed by means of a screw 36. The construction and operation of the sensor 35 will be described later in detail.

A peripheral gear 33*a* is provided on the outer circumferential surface of the support ring 33 except where the radial arm 34 originates. The function of the peripheral gear 33*a* will be described later in detail.

The cylinder 29 is formed at the lower end thereof with an integral peripheral flange 29*a* and in the bottom surface with a stepped central recess 29*b*. An inverted bowl-shaped rotary cover 37 comprises an upper half portion 37*a* and a lower half portion 37*b* connected to the upper half portion in a manner to be described presently. The upper portion 37*a* of the cover 37 has a central opening 38 and is secured to the bottom surface of the flange 29*a* of the previously mentioned inner support cylinder 29 by means of screws 39.

A boss-like member 40 is secured by a screw 41 to the lower end of the inner cylinder 29 in axial alignment therewith. The boss-like member 40 has its exterior surface so configured as to complement the stepped central recess 29*b* of the inner cylinder 29. The boss-like member 40 has a bottom surface 40*a* inclined a predetermined angle relative to the horizontal plane perpendicular to the common axis $0_1$. A core member 42 is fixed to the inclined bottom surface 40*a* of the boss-like member 40 so that the core member 42 is tilted relative to the boss-like member 40, with the axis $0_2$ of the core member 42 making an angle $\theta_2$ with the axis $0_1$ of the boss-like member 40.

A hat-like member 43 is supported by the core member 42 through a bearing 44 so that the member 43 is freely rotatable about the axis $0_2$ of the core member 42. The hat-like member 43 is provided with a brim or flange 43*a* the plane of which makes the same angle $\theta_2$ with the bottom surface of the member 43 which the axis $0_2$ of rotation of the member 43 makes with the axis $0_1$ of rotation of the inverted bowl-shaped cover 37.

Figure 11:
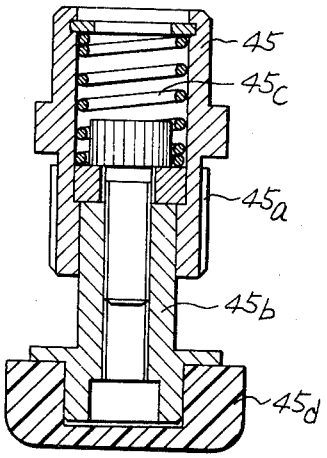
FIG. 11 is an enlarged view in vertical section of a pusher.

A first and a second circular array of pushers 44 are provided concentrically on the brim 43*a* so that they project downwardly from the bottom surface of the brim 43*a* for the purpose to be described presently. The pushers 44 are of the same construction and, as shown in FIG. 11 or 12, comprises a hollow cylindrical body 45 formed with an exterior thread 45*a* with which the pusher is fixed to the flange 43*a* of the hat-like member 43, and a piston rod 45*b* having a pad 45*d* fixed to the bottom end thereof, with a spring 45*c* inside the body 45 urging the piston rod 45*b* downwardly as shown in FIG. 11.

Figure 12:
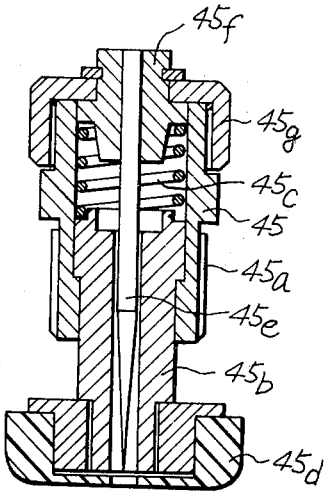
FIG. 12 is a view similar to FIG. 11 but showing a modified form.

As shown in FIG. 12, the pusher may be provided with an axial needle 45*e* held by a plug 45*f* which is fixed to the body 45 by means of a cap nut 45*g* screwed to the body 45. When the piston rod 45*b* is pushed upward against the force of the spring 45*c*, the pointed end of the needle 45e projects from the bottom surface of the pad 45d.

The lower portion 37b of the inverted bowl-shaped cover 37 is provided with a pair of brackets 37c, which are pivoted by a shaft 37d to the upper section 37a as shown in FIG. 2. At the diametrically opposite side the lower portion 37b is provided with a support member 46, to which a vertical shaft 46a is fixed as shown in FIG. 4. An internally threaded member 46b projects laterally from the upper portion 37a of the bowl-shaped cover 37, with a nut 46c having a central opening 46d through which the upper portion of the vertical shaft 46a passes, with a stop nut 46e screwed to the threaded upper end of the shaft 46a. A compression coil spring 46f is provided about the shaft 46a between the nut 46c and the support member 46 so as to urge the member 46 away from the nut 46c and consequently pivot the lower portion 37b of the bowl-shaped cover 37 clockwise in FIG. 4 about the shaft 37d a small distance away from the upper portion 37a until the stop nut 46e abuts the nut 46c. With this arrangement the lower portion 37b can be pivoted about the shaft 37d counterclockwise against the force of the spring 46f to increase the gap G between the opposed faces of the upper and the lower sections 13 and 14 of the machine.

The bottom face of the upper section 13 or the bowl-shaped cover 37 comprises a plane 47a perpendicular to the axis $0_1$ and a plane 47b inclined an angle $\theta_3$ relative to the plane 47a.

The previously mentioned lower section 14 of the machine comprises a pan-like member 48 formed integral with the previously mentioned arm 18. A disk 49 is disposed concentrically in the pan-like member 48 and rotatably supported by means of a bearing 50. An annular member 51 is attached to the periphery of the disk 49 to make the upper receiving surface of the disk flush with the upper plane of the pan-like member. The arrangement is such that when the pan-like member 48 is disposed at the previously mentioned first (operative) position adjacent the upper section 13 or the lower half portion 37b of the inverted bowl-shaped cover 37, the pan-like member 48 with the rotary disk 49 concentrically therein is in axial alignment with the inverted bowl-shaped cover 37.

Under the condition, as the hat-like member 43 is rotated about its own axis $0_2$ within the inverted bowl-shaped cover 37 as will be described later in detail, the lower end or pad 45d of one after another of the pushers 44 on the brim or flange 43a of the hat-like member 43 comes to project downwardly a little from the bottom plane 47a of the lower half portion 37b of the inverted bowl-shaped cover 37 so that a web 11 of cloth passing between the lower half 37b of the inverted bowl-shaped cover and the rotary disk 49 has its lateral edge or selvage sandwiched between the projecting pad 45d of the pusher 44 and the upper surface of the annular member 51 on the rotary disk 49.

Under the condition, as the web 11 is moved in the direction perpendicular to the plane of the sheet of paper of FIG. 4 from the obverse to the reverse side thereof, the friction between the web and the pad 45d and also between the web and the annular member 51 causes the hat-like member 43 and the rotary disk 49 to be rotated about their respective axes $0_2$ and $0_1$ counterclockwise as viewed from above in FIG. 4. As the hat-like member 43 and the rotary disk 49 are rotated, the pads of the pushers thereon successively come into contact with the running web so that the web is nipped or held between the pads and the annular member 51 of the rotary disk 49 and then go out of contact with the web thereby releasing hold of the web.

The point at which the pad of the pusher comes into contact with the web will be referred to as the "nipping point" designated by Pn and the point at which the pad of the pusher goes out of contact with the web, as the "releasing point" designated by Pr. The nipping point is at the upstream side of the releasing point in the running direction Y of the web, and those of the pushers between the nipping point and the releasing point have their pads in contact with the web. In other words, the web is held between the upper surface of the annular member 51 of the rotary disk 49 and the pads 45d of only those of the pushers between the above two points Pn and Pr.

In accordance with the invention, the releasing point Pr is kept fixed at such a position that the radial line between the axis $0_1$ and the releasing point Pr on the plane of the web lies substantially perpendicular to the running direction Y of the web 11, whereas the nipping point Pn can be changed by turning the bowl-shaped cover about the axis $0_1$ as will be described presently.

The operation of the device will be described with reference to FIGS. 13A to 13D which schematically show the associated component parts of the device. The hat-like member, however, is not shown for simplicity of illustration except the position of its axis $0_2$.

Normally, that is, when there is no need for stretching the web or correcting the running direction of the web, the position of the bowl-shaped cover 37 and consequently that of the hat-like member 43 relative to the rotary disk 49 is so determined that the pad 45d of only one of the pushers contacts the web, with the nipping point Pn coinciding with the releasing point Pr as in FIG. 13A.

Figure 13:
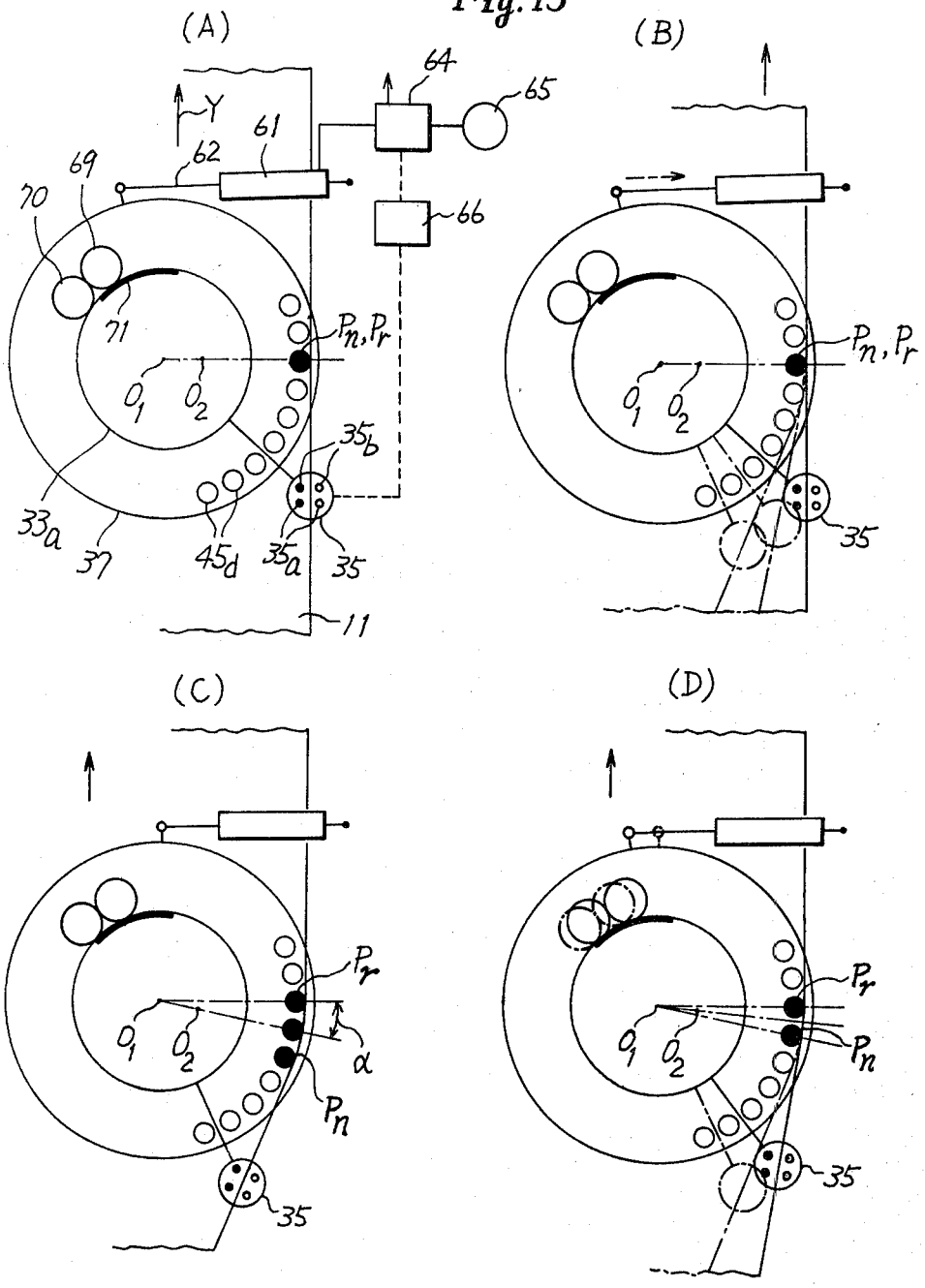
FIGS. 13A to 13D are views for explanation of the operation of the device of the invention.

If the width of the incoming web becomes narrower for some cause or other as shown in FIG. 13B and is to be widened, the bowl-shaped cover 37 is rotated about the axis $0_1$ clockwise in FIGS. 5 and 13 (or as viewed from above in FIG. 4). This causes the inner cylinder 29 to be rotated about the axis $0_1$ in the same direction and at the same time displaced downwardly in FIGS. 4 and 6 due to the engagement of the roller 31 of the pin 30 in the inclined slot 28 as previously mentioned.

The rotation of the inner cylinder 29 combined with simultaneous downward axial displacement thereof causes the hat-like member 43 to be nutated about the axis $0_1$ and simultaneously axially displaced downwardly, so that the nipping point Pn is displaced upstream in the running direction Y of the web (or clockwise in FIG. 13) from the releasing point Pr. This increases the number of the pushers, the pads of which can contact the web at one time as shown in FIG. 13C, so that a lateral pulling force is exerted on the web to spread or expand it laterally. In FIGS. 13A to 13D, the pads of the pushers which contact the web are shown as black dots while those which do not contact the web are shown as white dots.

The angle $\alpha$ through which the inverted bowl-shaped cover 37 is to be rotated is determined by the degree of displacement of the lateral edge of the incoming web from its normal position. The maximum of the angle $\alpha$ may sufficiently be 30° for practical purpose. As shown, those of the pushers which are within the angular range of twice the angle $\alpha$ contact the web.

Under the condition of FIG. 13C, if the incoming direction or angle of the lateral edge of the web changes as shown in FIG. 13D, the inverted bowl-shaped cover is rotated in the opposite direction, that is, counterclockwise so as to decrease the number of the pushers whose pads contact the web thereby to exert a lateral pulling force then required for proper spreading and guiding of the web.

At the opposite lateral side of the web, another machine of the same structure is disposed and operates in a similar manner. Since the releasing point Pr is kept unchanged despite changes in the incoming direction or angle of the web and as great a lateral pulling force as is required is exerted on the web in accordance with the incoming direction thereof, the web can always be stretched to a proper width while being simultaneously guided along a proper course.

The clockwise or counterclockwise rotation of the bowl-shaped cover 37 is effected by an actuator 60, which comprises a pneumatic cylinder 61 mounted on the bracket 15 and having a piston rod 62 the outer end of which is connected by a pivot pin 63 to the upper half portion 37*a* of the inverted bowl-shaped cover 37. When an air switch 64 is so actuated as to supply compressed air from a source 65 into the cylinder 61, the piston rod 62 is projected to turn the inverted bowl-shaped cover 37 counterclockwise in FIGS. 3, 5, 7 and 13 about the axis $0_1$ and simultaneously raise the cover 37. On the contrary, when the air switch 64 is so actuated as to evacuate the cylinder 61, the piston rod 62 is pulled in to turn the inverted bowl-shaped cover clockwise and simultaneously lower the cover.

The actuation of the air switch 64 is controlled by a control circuit 66 which operates in response to the signal from the photoelectric sensor 35. As schematically shown in FIG. 13, the sensor 35 is of a reflective type comprising two pairs of a light source 35*a* and a photoelectric element 35*b*. If a web 11 of cloth is positioned in front of the sensor, the light emitted from the source 35*a* is reflected by the web so as to enter the photoelectric element 35*b* paired with the light source, whereupon the element produces an electrical signal.

If the web is not in front of the sensor, the light emitted from the source 35*a* is absorbed in the black lining 67*a* inside a trough 67 formed along a portion of the circumference of the pan-like member 48 in opposed relation to the sensor. The length of the arcuate extension of the trough 67 substantially corresponds to the arcuate distance the sensor 35 is moved in the manner to be described presently. It should be noted that in FIG. 4, the sensor 35 and the trough 67 are shown at different positions from their respective actual positions for easiness of illustration.

In FIG. 13A, only one of the two photoelectric elements 35*b* is actuated. So long as this condition is maintained, with the web 11 running properly without any substantial lateral displacement or change in width, the bowl-shaped cover 37 of the machine is held at the illustrated (raised) position with only one (shown as a black dot) of the pushers contacting the web at the releasing point Pr thereby to exert little or no lateral pulling force on the selvage of the web.

Suppose that the lateral edge of the incoming web has run out of the sensor as shown in FIG. 13B so that neither of the photoelectric elements are actuated. The air switch 64 is so actuated as to evacuate the cylinder 61 to retract the piston rod 62. This causes the bowl-shaped cover to be rotated clockwise in FIGS. 5 and 13 and simultaneously lowered, thereby to increase the number of the pushers that contact the web as shown in FIG. 13C. Upon clockwise rotation of the bowl-shaped cover 37, the sensor 35 is simultaneously moved clockwise about the axis $0_1$ until the sensor catches up with the displaced selvage of the web so that one of the photoelectric elements comes to be actuated, leaving the other photoelectric element deenergized as shown in FIG. 13C, whereupon the clockwise rotation of the bowl-shaped cover 37 and angular displacement of the sensor are stopped.

Under the condition of FIG. 13C, the lateral pulling force exerted on the web by the increased number of the pushers now contacting the web causes it to be stretched to the required width. If the edge of web is displaced to the right until both of the photoelectric elements 35*b* are actuated as shown in phantom in FIG. 13D, the air switch 64 is so actuated as to supply air into the cylinder 61 to project the piston rod 62. This causes the bowl-shaped cover 37 to be rotated in the opposite direction, that is, counterclockwise and simultaneously raised, thereby to decrease the number of the pushers which contact the web. At the same time, the sensor is moved counterclockwise to the position shown in real line in FIG. 13D, whereupon the counterclockwise rotation of the bowl-shaped cover and the sensor 35 is stopped.

The above operation is controlled by the control circuit 66 in response to the signals from the sensor 35 so that the web runs along a properly guided course while it is being laterally stretched or expanded to a proper width despite fluctuations of the direction and/or width of the incoming web.

Figures 9, 10:
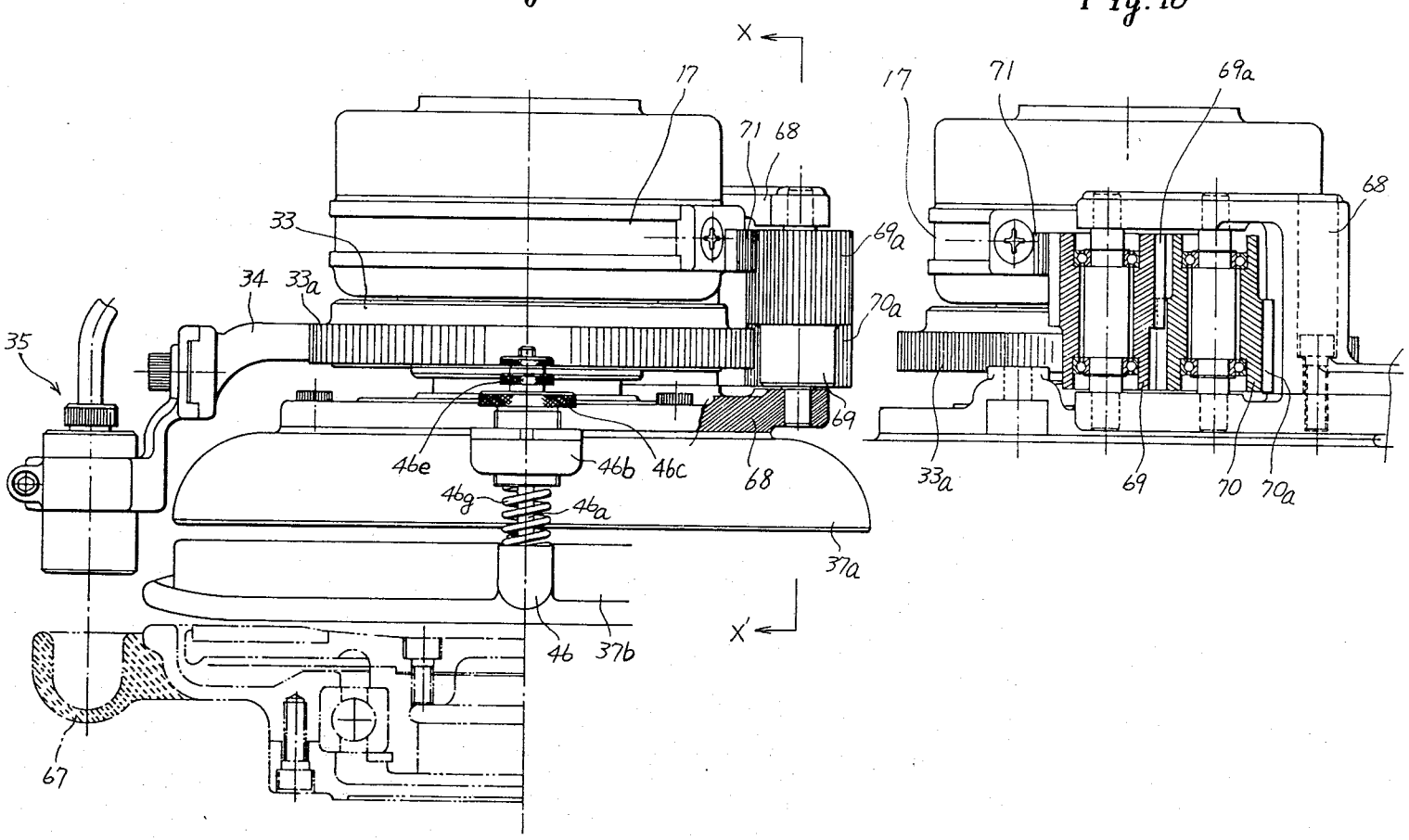
FIG. 9 is a fragmentary elevational view as viewed from the plane of the line IX–IX' in FIG. 3.
FIG. 10 is a sectional view taken along line X–X' in FIG. 9.

The above-mentioned simultaneous angular displacement of the sensor 35 accompanying the rotation of the inverted bowl-shaped cover 37 is effected through the gear connection as shown in FIGS. 9 and 10. As previously mentioned, the sensor 35 is fixed to the arm 34 integral with the support ring 33 carried by the outer hollow cylinder 24 through the bearing 32.

A bracket 68 is fixed to the upper surface of the inverted bowl-shaped cover 37. A pair of gears 69 and 70 are rotatably supported side by side by the bracket 68.

The gear 69 has teeth 69*a* extending a little longer than the upper half of the axial length thereof while the other gear 70 has teeth 70*a* extending a little longer than the lower half of the axial length thereof.

The teeth 69*a* and 70*a* of the two gears partly engage with each other and the teeth 70*a* of the gear 70 engage the gear 33*a* on the support ring 33 while the teeth 69*a* of the other gear 69 engage an external gear 71 fixed to the outer circumferential surface of the cylindrical casing 17.

In FIG. 13, the support ring 33 and the gear 33*a* are shown as a single circle, and the fixed gear 71 is shown in a thicker line as a portion of the circle for clarity of illustration. As the piston rod 62 is retracted to rotate the inverted bowl-shaped cover clockwise about the axis $0_1$ in FIG. 13A, the gear 69 is rotated about its own axis in the same direction. This causes the gear 70 to rotate counterclockwise and consequently the gear 33*a* and the support ring 33 to rotate clockwise, so that the sensor 35 is turned clockwise to catch up with the fleeing lateral edge of the web as previously mentioned.

As the piston rod 62 is projected to rotate the cover 37 counterclockwise, the sensor 35 is turned about the axis $0_1$ counterclockwise in a manner which will be easily seen from the foregoing description. The gear ratio of the associated gears is so determined that the angular speed of the sensor is twice that of the bowl-shaped cover for the best web guiding and stretching operation of the machine.

Thus, in accordance with the invention the releasing point is always kept at a fixed point regardless of fluctuation of the direction or angle of the incoming web so that the web can be guided along a stable course, and as soon as the lateral edge of the web is displaced from the sensor to either side, the sensor immediately catches up with the fleeing edge so that a suitable pulling force is always applied to the web thereby to spread it to a proper width.

What I claim is:

1. A device for use on one edge of an apparatus for spreading and guiding a web of textile fabric and the like flexible material, comprising: a first rotary member having a surface; first supporting means for supporting said first member rotatably about a first axis; a second rotary member provided at the periphery thereof with a plurality of pushing members and means for resiliently projecting said pushing members from the surface of said periphery; second supporting means for supporting said second rotary member rotatably about a second axis tilted a predetermined angle relative to said first axis and in generally opposed relation to said surface of said first rotary member, thereby to hold a selvage of said web between said first and second rotary members, with said pushing members successively coming to engage the selvage of said web on said surface of said first rotary member at a nipping point and disengaging therefrom at a releasing point as said first and second rotary members are rotated by friction with said web being fed; means for detecting displacement of said web from a predetermined direction; and means operable in response to said detecting means for turning said second supporting means about said first axis and simultaneously displacing said second supporting means axially of said first axis, thereby to nutate said second rotary member about said first axis and simultaneously move said second rotary member axially of said first axis relative to said first rotary member so as to change said nipping point while keeping said releasing point substantially unchanged.

2. The device of claim 1, wherein said pushing members are provided with a pad on a projecting end thereof and said second rotary member comprises a hat-like member having a brim on which said pushing members are resiliently mounted so that their pads face said surface of said first rotary member.

3. The device of claim 1, and further comprising means for keeping said releasing point of said pushing members at such a position that a radial line between said first axis and said releasing point lies substantially perpendicular to a running direction of said web as said web leaves said device.

4. The device of claim 1, wherein said first supporting means comprises a pan-like member in which said first rotary member is rotatably supported about said first axis; and said second supporting means comprises an inverted bowl-shaped member arranged in axial alignment with said pan-like member in opposed relation thereto and enclosing said second rotary member; and said second supporting means comprises an outer hollow cylindrical member, an inner cylindrical member disposed concentrically in said outer hollow cylindrical member and having said inverted bowl-shaped member fixed to the bottom end thereof, a casing rotatably supporting said outer cylindrical member about said first axis, and means for turning said inverted bowl-shaped member about said first axis; said casing being provided with a slot extending in a direction perpendicular to said first axis, and said outer hollow cylindrical member being provided with a slot inclined from the direction perpendicular to said first axis and also with a radial pin extending outwardly through said slot in said casing, and said inner cylindrical member being provided with a radially outwardly extending pin engaging said inclined slot in said outer hollow cylindrical member for sliding movement relative thereto; and said detecting means comprises a photoelectric sensor supported by said outer cylindrical member and means for angularly displacing said sensor about said first axis independently of said outer cylindrical member.

5. The device of claim 4, and wherein said means for angularly displacing said photoelectric sensor about said first axis includes means for displacing the sensor at a speed twice that of a speed of rotation of said inverted bowl-shaped member about said first axis.

6. An apparatus for spreading and guiding a web of textile fabric and the like flexible material, comprising: a pair of web spreading and guiding devices and means for supporting said devices in a laterally spaced apart relation to each other so that said devices are disposed at the opposite sides of said web to hold the selvages thereof; each of said devices comprising: a first rotary member having a surface; first supporting means for supporting said first member rotatably about a first axis; a second rotary member provided at the periphery thereof with a plurality of pushing members and means for resiliently projecting said pushing members from the surface of said periphery; second supporting means for supporting said second rotary member rotatably about a second axis tilted a predetermined angle relative to said first axis and in generally opposed relation to said surface of said first rotary member, thereby to hold a selvage of said web between said first and second rotary members, with said pushing members successively coming to engage the selvage of said web on said surface of said first rotary member at a nipping point and disengaging therefrom at a releasing point as said first and second rotary members are rotated by friction with said web being fed; means for detecting displacement of said web from a predetermined direction; and means operable in response to said detecting means for turning said second supporting means about said first axis and simultaneously displacing said second supporting means axially of said first axis, thereby to nutate said second rotary member about said first axis and simultaneously move said second rotary member axially of said first axis relative to said first rotary member so as to change said nipping point while keeping said releasing point substantially unchanged.

7. The apparatus of claim 6, wherein, in each of said devices, said pushing members are provided with a pad on a projecting end thereof and said second rotary member comprises a hat-like member having a brim on which said pushing members are resiliently mounted so that their pads face said surface of said first rotary member.

8. The apparatus of claim 6, and further comprising, in each of said devices, means for keeping said releasing point of said pushing members at such a position that a radial line between said first axis and said releasing point lies substantially perpendicular to a running direction of said web as said web leaves said device.

9. The apparatus of claim 6, wherein, in each of said devices, said first supporting means comprises a pan-like member in which said first rotary member is rotatably supported about said first axis; and said second supporting means comprises an inverted bowl-shaped member arranged in axial alignment with said pan-like member in opposed relation thereto and enclosing said second rotary member; and said second supporting means comprises an outer hollow cylindrical member, an inner cylindrical member disposed concentrically in said outer hollow cylindrical member and having said inverted bowl-shaped member fixed to the bottom end thereof, a casing rotatably supporting said outer cylindrical member about said first axis, and means for turning said inverted bowl-shaped member about said first axis; said casing being provided with a slot extending in a direction perpendicular to said first axis, and said outer hollow cylindrical member being provided with a slot inclined from the direction perpendicular to said first axis and also with a radial pin extending outwardly through said slot in said casing, and said inner cylindrical member being provided with a radially outwardly extending pin engaging said inclined slot in said outer hollow cylindrical member for sliding movement relative thereto; and said detecting means comprising a photoelectric sensor supported by said outer cylindrical member and means for angularly displacing said sensor about said first axis independently of said outer cylindrical member.

10. The apparatus of claim 9, wherein, in each of said devices, the means for angularly displacing said photoelectric sensor about said first axis includes means for displacing the sensor at a speed twice that of a speed of rotation of said inverted bowl-shaped member about said first axis.

* * * * *